United States Patent [19]

Gross et al.

[11] 4,021,032

[45] May 3, 1977

[54] FEEDING DEVICE

[75] Inventors: Joseph Gross, Plainview; Stanley Stankowski, E. Northport, both of N.Y.

[73] Assignee: Computer Terminal Systems, Inc., Plainview, N.Y.

[22] Filed: Mar. 12, 1976

[21] Appl. No.: 666,363

[52] U.S. Cl. ..... 271/166; 271/259

[51] Int. Cl.[2] ..... B65H 1/06

[58] Field of Search ..... 271/35, 134, 165, 166, 271/258, 259

[56] References Cited

UNITED STATES PATENTS

| | | | |
|---|---|---|---|
| 2,233,150 | 2/1941 | Welk | 271/166 |
| 3,907,278 | 9/1975 | Jaton | 271/35 X |
| 3,933,350 | 1/1976 | Mignano | 271/165 X |
| 3,948,506 | 4/1976 | Crimmins et al. | 271/165 |

*Primary Examiner*—Robert W. Saifer
*Attorney, Agent, or Firm*—Nolte and Nolte

[57] ABSTRACT

A device for individually feeding a plurality of stacked flat articles such as cards and the like comprises drivable means for frictionally engaging and feeding the articles, means for retaining the articles in an upright stack with the bottom article resting partly on the drivable means and means partly supporting the stack at an angle to the horizontal thereby to relieve part of the weight of the stack from the drivable means.

4 Claims, 7 Drawing Figures

FEEDING DEVICE

BACKGROUND OF THE INVENTION

This invention relates to a feeding device. More particularly, this invention relates to a device for individually feeding a plurality of stacked flat articles. In a specific, preferred embodiment, the articles are cards or tickets and the device feeds the cards or tickets to a conventional printer which forms no part of the present invention.

Feeding devices of the type mentioned hereinabove are substantially hoppers. Frequently, such hoppers have a capacity of only several hundred cards or tickets (hereinafter called "cards") because greater numbers of cards overload the drive wheels provided at the bottom of the hopper for ejecting the cards; in particular, the drive wheels are no longer able to remove the bottom card from the stack. In addition, the hoppers are overly sensitive to card shape and derivations from the optimum flat article. Various solutions have been proposed for this problem. In general, the solutions are quite complicated. In the present invention, there is provided a simple solution to this problem which increases the capacity of the hopper to greater than 600 cards.

In particular, the feeding device of the invention comprises the conventional drivable means for frictionally engaging and feeding cards, means for retaining the cards in an upright stack with the bottom card resting partly on the drivable means and means partly supporting the stack at an angle to the horizontal thereby to relieve part of the weight of the stack from the drivable means.

In a particular, preferred embodiment, the means for retaining the cards in an upright stack comprises a hopper having a front wall at the extremity of the hopper from which the cards are fed, a rear wall opposite the front wall and side walls at right angles to the front and rear walls, and the means partly supporting the stack comprises a member, one end of which is hooked, the hooked end loosely fitting on the top edge of the rear wall of the hopper, and the other end of the member extending upwardly and toward the front wall of the hopper and carrying a roller rotatable about a horizontal axis parallel to the front and rear walls of the stack up so that the cards in the stack are tilted toward the front wall of the hopper and the hooked end of the member being restrained by the stack of cards from moving toward the front wall of the hopper when the hopper is full and moving toward the front wall of the hopper and thereby lowering the roller as the hopper empties, the roller thereby bearing a lesser and lesser proportion of the weight of the stack as the stack is depleted by feeding of the cards from the hopper.

Another feature of the invention is ramp means mounted on the rear wall of the hopper, the ramp means being downwardly inclined toward the front wall of the hopper. An exit slot is provided for the cards, the slot being of greater height than one of the cards but lesser height than two of the cards and passing through the front wall of the hopper. A platen is provided which defines the bottom of the exit slot and supports the stack adjacent to the exit slot. There is also provided a member having a tapered end extending downwardly on the inside of the front wall of the hopper and the bottom extremity of which defines the top of the exit slot. The ramp means tends to urge the bottom card beneath the tapered end of the member thereby to help ensure reliable feeding of a single card from the bottom of the stack. Means may be provided for adjusting the height of the slot. For example, the member having a tapered end may be vertically adjustably mounted on the front wall of the hopper.

Yet another feature of the invention is the provision of first and second switches each having an arm extending into the hopper and adapted to engage the front side of the stack, the two arms being located one higher than the other and both near the platen, the higher switch being adapted for actuating means for signaling a low card supply in the hopper when the stack no longer engages the arm of the higher switch and the lower switch being adapted for actuating means for signaling that the hopper is now considered empty when the stack no longer engages the arm of the lower switch, although the hopper may, in fact, contain a small quantity of cards.

BRIEF DESCRIPTION OF THE DRAWINGS

The invention will now be described by reference to a specific embodiment, as illustrated in the drawings, in which.

DESCRIPTION OF THE PREFERRED EMBOIDMENTS

Figure 1:
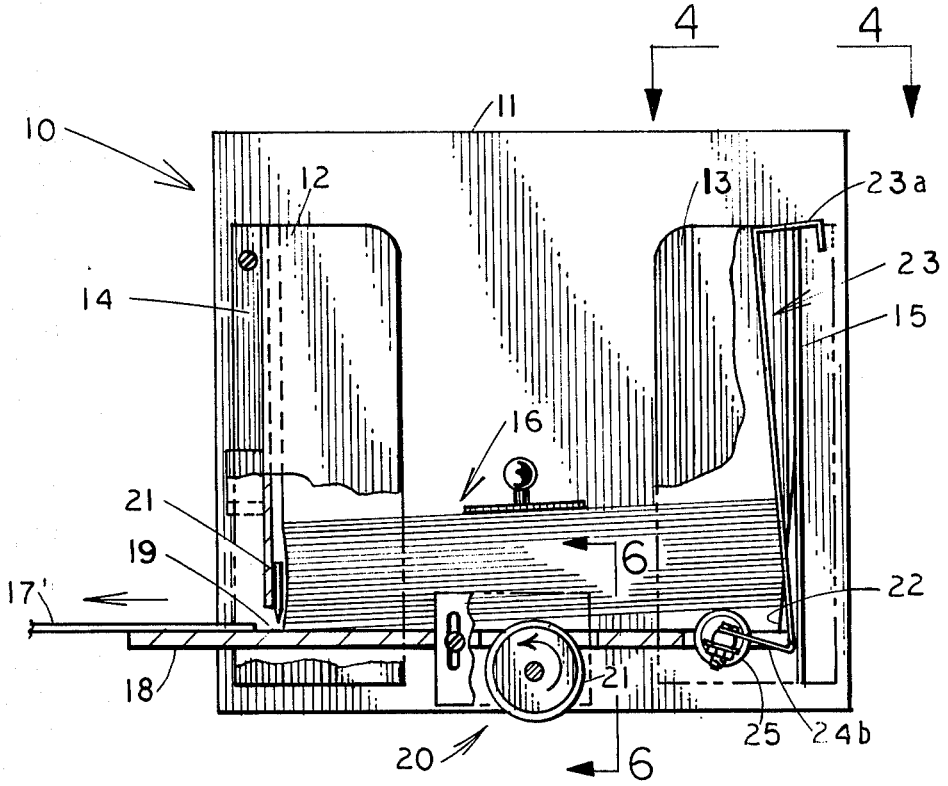
FIG. 1 is a side elevation, partly in section, of the feeding device according to the invention.
Figure 6:
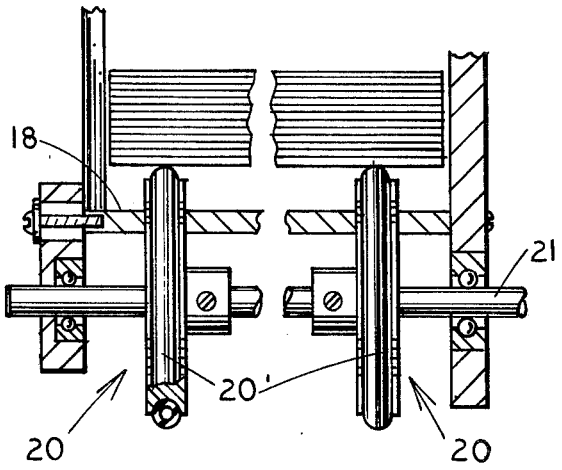
FIG. 6 is a front elevation, partly in section, of the bottom portion of the feeding device.

With reference to FIG. 1, it is seen that the feeding device 10 includes a mounting plate 11 which serves as a side wall on one side of the hopper and, opposite thereto, additional hopper side walls 12 and 13 as well as hopper front end wall 14 and rear end wall 15. A stack 16 of cards 17 is loaded in the hopper. One of the cards, from the bottom of the stack, 17', is shown as it exits from the feed device. A platen 18 helps support the front end of the stack 16. Contiguous with the platen 18 and passing through the front wall 14 is an exit slot 19 for the cards 17. One or more (typically, but not necessarily, two or three) wheels 20 each having a rubber ring 20' and mounted on a driven shaft 21 pass through openings provided in the platen 18 and frictionally engage the bottom card of the stack (FIG. 6).

Figure 4:
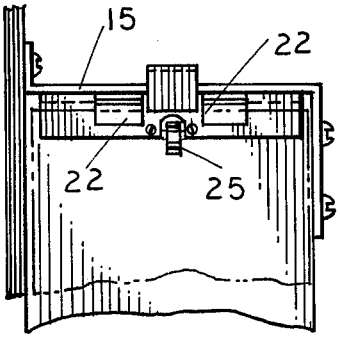
FIG. 4 is a plan view of the same portion of the feeding device as illustrated in FIGS. 2 and 3.
Figure 7:
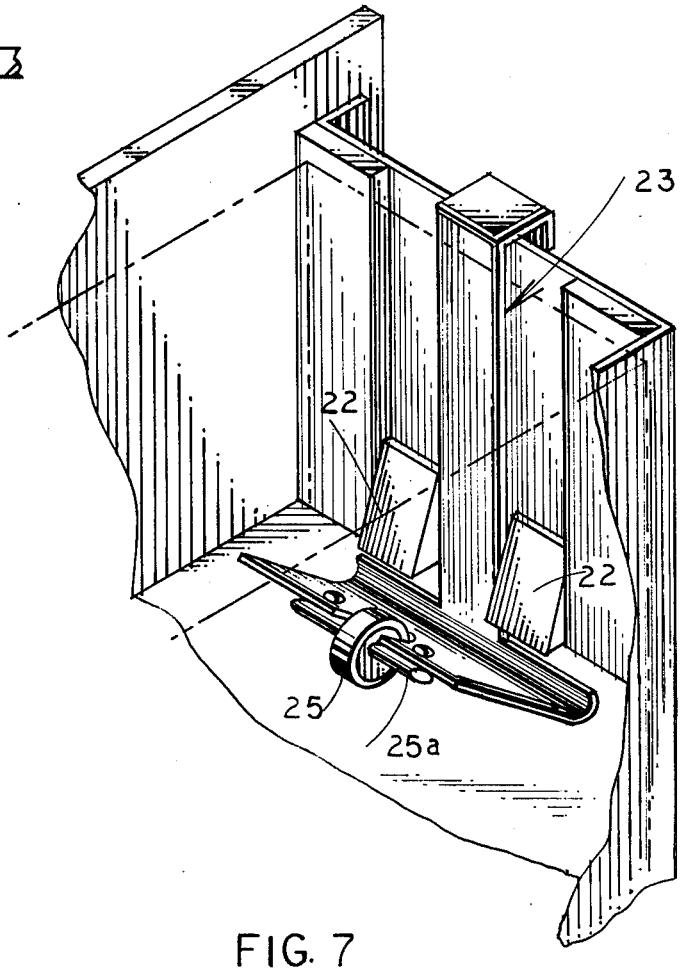
FIG. 7 is an isometric, partly broken away, view of the rear portion of the feeding device.

A tapered striker plate 21 is provided. The tapered end of the striker plate 21 forms a top edge of the slot 19, establishes the exit slot height and permits only the bottom card to pass thereunder. It is apparent that the striker plate 21 need not extend across the entire width of the exit slot. Typically, but not necessarily, the striker plate will extend only across a central portion of the exit slot. Ramps 22 (FIGS. 1, 4 and 7) are provided on the rear wall 15. The ramps 22 incline downwardly toward the front of the hopper. This tends to urge the bottom card under the striker plate 21 and into the thus formed slot 19 as the wheels 20 frictionally drive the bottom card, thus ensuring reliable feeding.

A lever member 23 is provided with a hooked end 23a and an upwardly inclined end 24b. The hooked end 23a fits loosely on the top edge of the rear wall 15 of the hopper. The upwardly inclined end 24b carries a roller 25 rotatably mounted on a shaft 25a. It is seen that the roller 25 bears some of the weight of the stack 16, thus relieving the weight on the wheels 20. A weight 24 is placed on top of the stack in order to assure that there be sufficient frictional engagement between the wheels 20 and the bottom card of the stack (see FIGS. 1 and 2).

Figure 2:
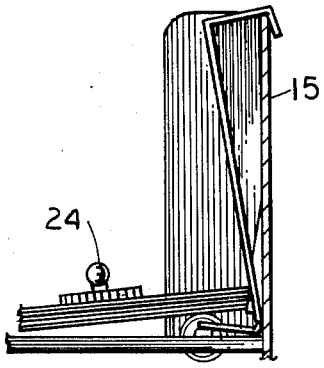
FIG. 2 shows a portion of the feeding device in a less filled condition than illustrated in FIG. 1.
Figure 3:
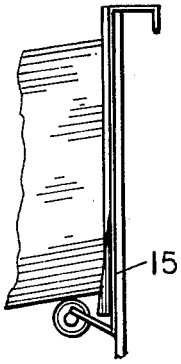
FIG. 3 shows the same portion of the feeding device in a more filled position than illustrated in FIG. 1.

By comparison of FIGS. 1,2 and 3, it can be seen that the less filled is the device 10 of the invention the lower is the roller 25, thus causing a greater proportion of the weight of the stack 16 to bear against the drive wheels 20.

Figure 5:
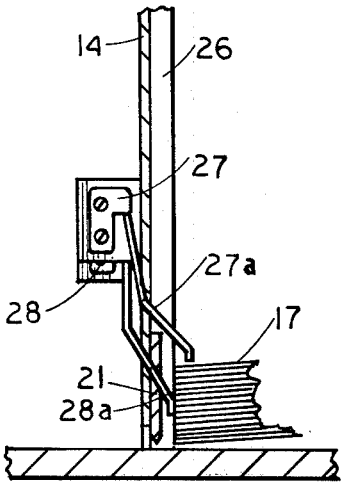
FIG. 5 is a side elevation, partly in section, of the front end of the feeding device.

With reference to FIG. 5, it is seen that a guide block 26 is provided on the front wall 14 against which block the front side of the stack 16 bears. It is also seen that there is mounted on the front wall 14 upper and lower switches 27 and 28, respectively, provided with respective arms 27a and 28a extending through openings into the hopper. When the front edge of the stack 16 bears against either or both arms, it holds the arm in a retracted position in which the respective switch is open. When the level of the stack falls below the arm, the arm moves further into the hopper whereupon the switch is closed. In this manner, the upper switch 27 is used to close a circuit (not shown) to actuate a signal to indicate that the level of cards in the hopper is getting low and the lower switch 28 is used to close a circuit (not shown) to actuate a signal to indicate that the hopper is now considered empty, although, in fact, it may contain a small quantity of cards. In the latter instance, it may be convenient to have the switch actuate an alarm and shut off the feed device and the printer to which the feed device is feeding. Of course, this is only by way of example.

It is intended that modifications and variations within the ordinary skill of the art be encompassed by the appended claims. For example, the support wheel 25 may be adjustably fixedly mounted on a bracket rather than being mounted on a liner which moves to effect self adjustment, although this generally would be considered a less desirable arrangement. Further, the exit slot can be formed by the aforementioned striker plate and a very low friction surfce such as which can be simply implemented by a roller bearing mounted for rotation about an axis parallel to the axis of roller 25 but at the front portion of the hopper device. Also, the drive wheels 20 can be located anywhere in the platen and can be implemented by a continuous roller the width of the hopper device or by any portions thereof.

What is claimed is:

1. A device for individually feeding a plurality of stacked flat articles comprising a hopper for retaining the cards in an upright stack with the bottom card resting partly on drivable means and means partly supporting the stack at an angle to the horizontal thereby to relieve part of the weight of the stack from the drivable means, said hopper having a front wall at the extremity of the hopper from which the articles are fed, a rear wall opposite the front wall and side walls at right angles to the front and rear walls, said means partly supporting the stack comprising a member, one end of which is hooked, the hooked end loosely fitting on the top edge of the rear wall of the hopper, and the other end of the member extending upwardly and toward the front wall of the hopper and carrying a roller rotatable about the horizontal axis parallel to the front and rear walls of the hopper, the roller being adapted to hold the rear of the stack of articles so that the articles in the stack are tilted toward the front wall of the hopper and said hooked end of said member being restrained by the stacked articles from moving toward the front wall of the hopper when the hopper is full and said hooked end of said member moving toward the front wall of the hopper and thereby lowering the roller as the hopper empties, the roller thereby bearing a lesser and lesser proportion of the weight of the stack as the stack is depleted by feeding of the articles from the hopper.

2. A device according to claim 1, further comprising ramp means mounted on the rear wall of the hopper, said ramp means being downwardly inclined toward the front wall of the hopper, an exit slot for the article of greater height than one of the articles but of lesser height than two of the articles and extending through the front wall of the hopper, and a platen continguous with the exit slot for supporting the stack adjacent the exit slot, said ramp means tending to urge the bottom articles of the stack into the exit slot.

3. A device according to claim 2, further comprising a member having a tapered end extending downwardly on the inside of the front wall of the hopper and forming a top edge of the exit slot.

4. A device according to claim 3, further comprising first and second switches each having an arm extending into the hopper and adapted to engage the front side of the stack, the two arms being located one higher than the other and both near the platen, the higher switch being adapted for actuating means for signaling a low article supply in the hopper when the stack no longer engages the arm of the higher switch and the lower switch being adapted for actuating means for signaling an arbitrarily determined empty condition of the hopper when the stack no longer engages the arm of the lower switch.

* * * * *

UNITED STATES PATENT AND TRADEMARK OFFICE

CERTIFICATE OF CORRECTION

PATENT NO. : 4,021,032

DATED : May 3, 1977

INVENTOR(S) : Joseph Gross et al

It is certified that error appears in the above-identified patent and that said Letters Patent are hereby corrected as shown below:

Column 4, line 45, delete "side".

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*